United States Patent [19]

Fletcher et al.

[11] Patent Number: 4,550,834

[45] Date of Patent: Nov. 5, 1985

[54] SELF-ERECTING END-LOAD TOP-DISPENSING CONTAINER

[75] Inventors: Richard J. Fletcher, Wilmington, Del.; Henry Wischusen, III, Lilburn, Ga.

[73] Assignees: E. I. Du Pont de Nemours & Co., Wilmington, Del.; Rock-Tenn Co., Norcross, Ga.

[21] Appl. No.: 558,030

[22] Filed: Dec. 5, 1983

[51] Int. Cl.[4] ..... B65D 17/28; B65D 17/40

[52] U.S. Cl. ..... 206/611; 206/609; 206/631; 206/624; 229/39 R; 229/DIG. 5

[58] Field of Search ..... 206/611, 612, 609, 624, 206/625, 626, 634; 229/39 R, DIG. 5

[56] References Cited

U.S. PATENT DOCUMENTS

| | | | |
|---|---|---|---|
| 637,642 | 11/1899 | Morgan | 229/38 |
| 1,143,103 | 6/1915 | Cameron . | |
| 1,925,102 | 9/1933 | Levkoff . | |
| 2,002,005 | 5/1935 | Gottlieb | 229/38 |
| 2,266,958 | 12/1941 | Corbin . | |
| 2,686,629 | 8/1954 | Inman | 229/39 R |
| 2,804,256 | 8/1957 | Inman | 206/625 |
| 2,936,104 | 5/1960 | De Blaere | 206/625 |
| 3,110,434 | 11/1963 | Lindo et al. | 206/611 |
| 3,208,583 | 9/1965 | Kamps . | |
| 3,281,054 | 10/1966 | Buttery et al. . | |
| 3,399,820 | 9/1968 | Foster et al. | 206/628 |
| 3,522,907 | 8/1970 | Utterback, Jr. | 206/628 |
| 3,580,483 | 5/1971 | Young . | |
| 3,618,848 | 11/1971 | Palowski et al. . | |
| 3,659,707 | 5/1972 | Nilsson et al. . | |
| 3,669,251 | 6/1972 | Phillips, Jr. . | |
| 3,688,972 | 9/1972 | Mahon | 206/628 |
| 3,690,543 | 9/1972 | Zeitter . | |
| 4,000,811 | 1/1977 | Hardison et al. . | |
| 4,043,503 | 8/1977 | Meyers et al. | 206/625 |
| 4,054,203 | 10/1977 | Farquhar | 229/38 |
| 4,102,457 | 7/1978 | Meyers | 206/611 |
| 4,113,100 | 9/1978 | Soja et al. . | |
| 4,216,861 | 8/1980 | Oliff | 206/611 |
| 4,291,828 | 9/1981 | Nigro . | |
| 4,449,633 | 5/1984 | Johnson et al. | 206/624 |

FOREIGN PATENT DOCUMENTS

| | | | |
|---|---|---|---|
| 1129223 | 1/1957 | France | 206/625 |
| 1400046 | 4/1965 | France . | |

*Primary Examiner*—Stephen P. Garbe
*Attorney, Agent, or Firm*—Jones & Askew

[57] ABSTRACT

A self-erecting end-loading top-dispensing container which is convertible from a substantially flattened configuration for shipping the empty container into an erected box-like configuration for loading product into the container and for shipping loaded containers. By removing a tear-away portion of the top panel, the container is convertible into a tray having an open top for dispensing product. Connecting webs join the end closures of the container to the front and rear side walls, preserving the structural integrity of the container when the removable top is torn away.

9 Claims, 6 Drawing Figures

SELF-ERECTING END-LOAD TOP-DISPENSING CONTAINER

TECHNICAL FIELD

The present invention relates generally to disposable containers formed from a single sheet of paperboard or the like, and particularly relates to a container which is shipped in a flattened configuration, erected into a box-like configuration for loading product into the container and for shipping loaded containers, and is convertible into a tray having an open top for dispensing product.

BACKGROUND ART

Many attempts have been made in the packaging industry to provide customers with convenient containers which are easy and economical to ship prior to loading, and which when loaded with product allow convenient dispensing of product carried by the container. In the health services and medical professions, there is often a need to dispense medical goods in small stackable trays, each tray carrying the items needed for one patient. For example, small plastic trays carrying a syringe, a cleaning swab, and a drug may be stacked several trays high and shipped as a unit by the manufacturer of the medical goods. A zippered score allows a portion of the container to be removed to grasp the trays one at a time for use with an individual patient.

Typically, dispensers for these products have end closures which are glued once the stack of product trays is loaded into the container. The use of end closures which are glued unfortunately requires that the empty containers be assembled and glued at the manufacturer's facilities after the containers are loaded, thereby requiring an investment in container-erecting equipment.

Designs for containers which include end closures which are not glued but consist of tuck flaps at either end solve the problem of the need for container-erecting equipment, but these type containers cannot reliably include a tear-away portion on the container. Tearing away a removable portion of a tuck-flap type container in order to allow dispensing product results in an unstable container which simply falls apart and does not function to hold together the supply of product trays.

SUMMARY OF THE INVENTION

The present invention solves problems with prior art dispensing containers by providing an erectable, end-loading, top-dispensing container which is convertible from a substantially flattened configuration for shipping the empty containers into an erected box-like configuration for loading product into the container and for shipping loaded containers. The container is further convertible into a tray having an open top for dispensing product.

Generally described, the present invention comprises a container fabricated from a single blank of paperboard or the like, comprising a top panel, a bottom panel supported in spaced-apart relation to the top panel, a front side wall and a rear side wall each connecting the top panel and the bottom panel, and a pair of collapsible end closures which assume a collapsed, flattened position when the container is in a flattened configuration and which assume an erected position when the container is erected. A tear score is provided in the container for removing a substantial portion of the top panel to create an open-topped tray for dispensing product, and connecting webs are provided for joining the end closures to the front side wall and the rear side wall for maintaining the structural integrity of the container when the tear-away portion of the top panel is removed.

According to the preferred embodiment of the invention, one of the end closures comprises interlocking flaps defining an automatic end closure. The flaps automatically interlock to form an assembled end wall for the container when the container is erected. The other end closure preferably comprises a tuck panel which assumes a disassembled flattened configuration when the container is flattened, and which includes a tuck flap insertable in between a connecting web and the bottom panel to define an openable and closable product insertion end wall when the container is erected.

Preferably, the connecting webs comprise container material extending between the tuck panel and each of the side walls. Each web includes a score line extending from the intersection of the tuck panel and the adjoining side wall to facilitate folding of the web when the tuck panel closure is closed.

Also in the preferred embodiment, the tear score comprises a line tearing defined by a plurality of spaced-apart cuts in the container material. The cuts define a plurality of container material bridges between the portion of the top panel to be removed and the remainder of the container. The bridges are operative to twist without delamination when the container is folded along the score in the flattened configuration, and are further operative to permit controlled delamination along the score line when the removable portion of the top panel is torn away. Preferably, the spaced-apart cuts are generally Z-shaped and include a center cut line oriented angularly with respect to the line of tearing, and further include a pair of generally parallel cut lines extending in opposite directions from the end of the center cut line.

Also in the preferred embodiment, a second tear score is included for removing a portion of one of the side walls together with the removed part of the top panel, so as to allow convenient access to product within the container. The removable portion is preferably V-shaped so as to create a relatively wide opening near the top of the container and a relatively narrow opening disposed toward the bottom of the container for inserting a finger to grasp the removable portion of the side panel. Also, in the preferred embodiment a web of container material is included between the automatic end closure and the front side wall to provide additional structural integrity when the portion of the top panel is removed.

The invention has the further advantage that it can be constructed from a single sheet of paperboard or the like which can be folded and glued into a flat configuration for shipping and handling. When the container is to be loaded with product, it can be easily popped up into an erected configuration ready to receive product into the opened end closure. The tuck-flap end closure is then closed, and the filled container is ready to be shipped.

Thus, it is an object of the present invention to provide a self-erecting end-loading, top-dispensing container.

It is a further object of the present invention to provide a container which is convertible from a substantially flattened configuration for shipping the empty containers into an erected box-like configuration for loading product into the container and for shipping loading containers, and which is further convertible into a tray having an open top for dispensing product.

It is a further object of the present invention to provide an end-loading, top-dispensing container wherein a portion of the top of the container is removed to allow dispensing product, and wherein the end closures of the container are joined to the side walls of the container for maintaining the structural integrity of container when the removable portion of the top panel is removed for dispensing product.

It is a further object of the present invention to provide an erectable, top-dispensing container convertible from a flattened configuration into a box-like configuration having a top portion which is removable for dispensing product, wherein the removable top portion is defined by a tear score line which permits twisting of the container material without delamination when the container is folded in the flattened configuration but which permits controlled delamination along the tear score when the portion of the top panel is removed.

Other objects, features and advantages of the present invention will become apparent upon reading the following detailed description of a preferred embodiment of the invention, when taken in conjunction with the drawing and the appended claims.

DETAILED DESCRIPTION

Figure 1:
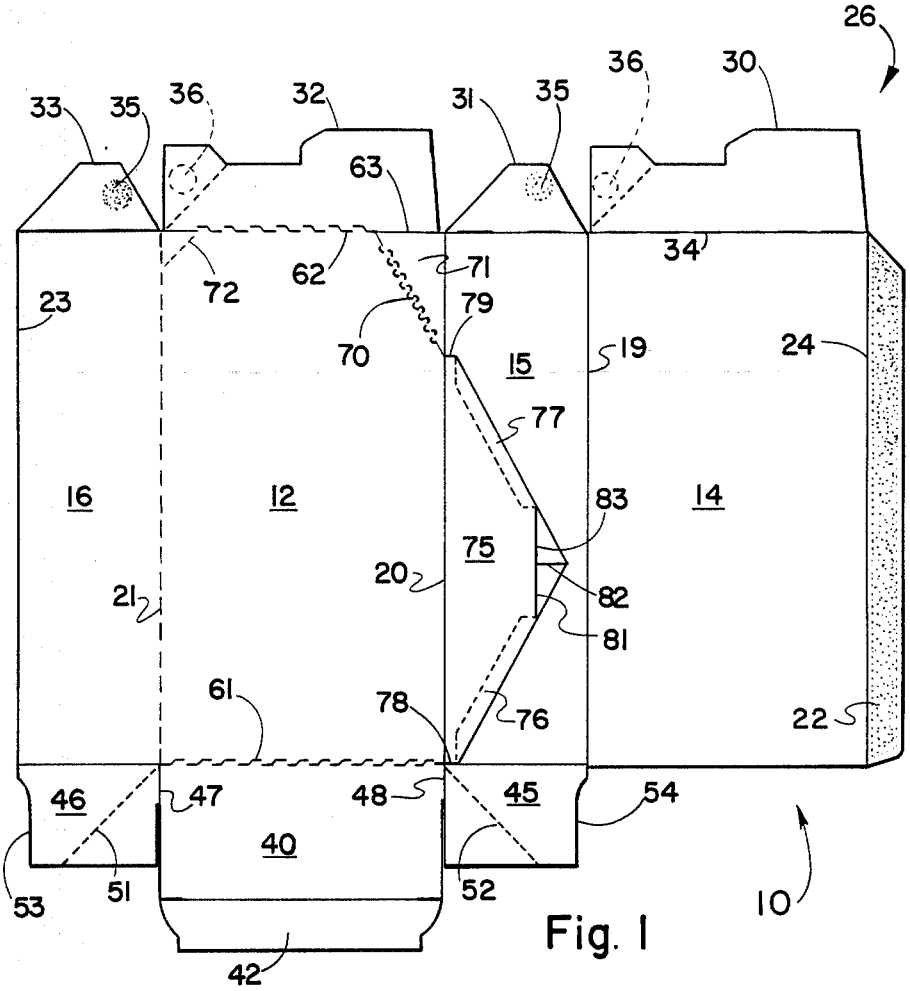
FIG. 1 is an outside plan view of a paperboard blank from which the container of the present invention is assembled.

Referring now in more detail to the drawings, in which like reference numerals represent like parts throughout the several views, FIG. 1 shows a paperboard blank 10 which is assembled to construct the container of the present invention. The blank 10 is cut and scored from paperboard or the like.

The blank 10 includes a top panel 12, a bottom panel 14, a front or first side wall member or panel 15, and a rear or second side wall member or panel 16. The top or first panel member 12 is substantially rectangular, and is hingedly connected along a transverse score line 20 to the front side wall 15. The top panel is hingedly connected at another transverse score line 21 to the rear side wall 16. A glue flap 22 is hingedly connected at still another transverse score line 24 to permit securing the bottom panel 14 to the rear side wall 16.

Figure 2:
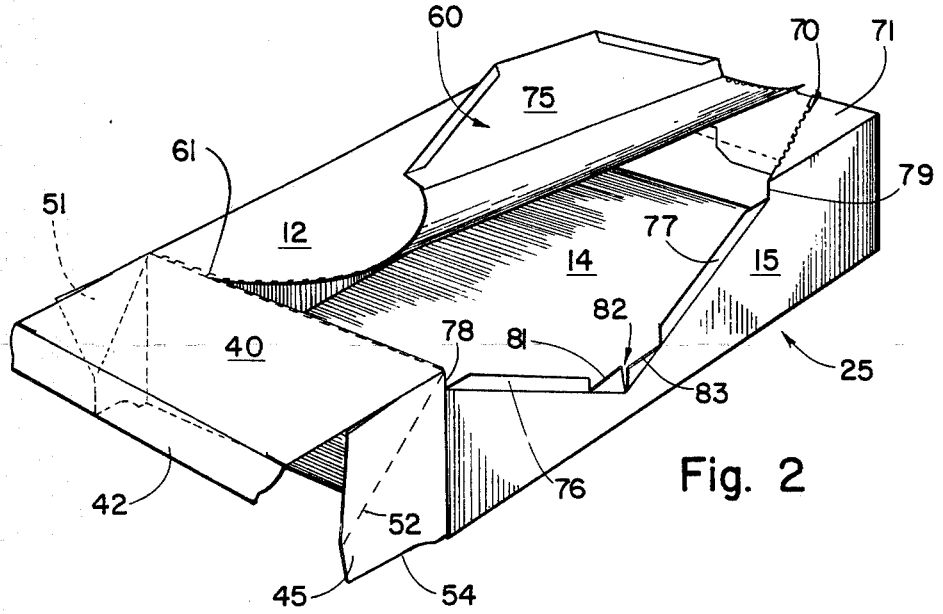
FIG. 2 is a pictorial view of a container embodying the present invention in its erected configuration, showing a portion of the top of the container being partially removed.
Figure 5:
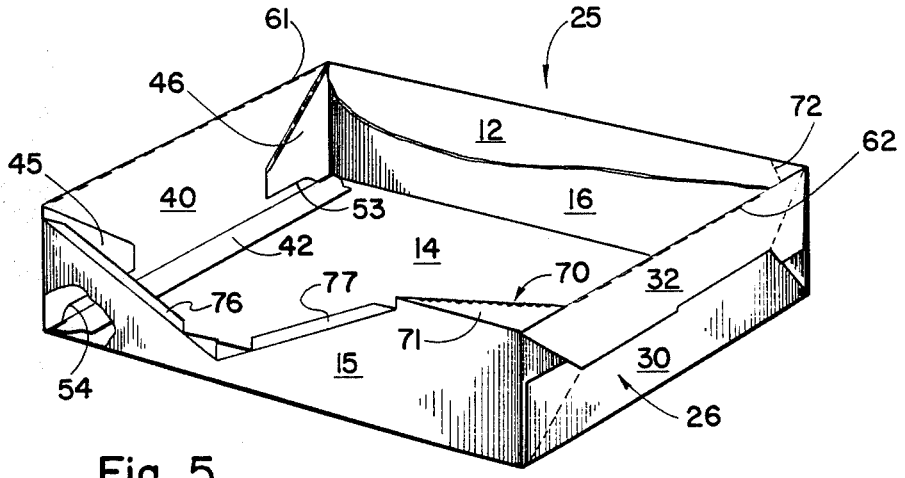
FIG. 5 is a pictorial view of the container shown in FIG. 2 with a portion broken away to show interior detail, and showing the resultant tray with the portion of the top panel removed.

Referring to FIGS. 2 and 5, it is seen that the side walls 15, 16 hold the top and bottom panels in spaced-apart relation, and a rectangular tubular enclosure is formed when a cut edge 23 of the rear side wall 16 is adhered to the glue flap 22.

Preferably, the transverse score line 21 connecting the top panel 12 and the rear side wall 16 is a jump cut score which allows removal of the top panel in a manner described below.

As best seen in FIG. 5, the completed and erected container 25 has a closed end indicated generally at 26, which is closed by flap means forming a conventional "automatic end closure". In FIG. 1, the automatic end closure 26 is seen to comprise an end flap 30 foldably connected to the bottom panel 14, an end flap 31 foldably connected to the front side wall 15, an end flap 32 foldably connected to the top panel 12, and an end flap 33 foldably connected to the rear side wall 16, all of the end flaps 30–33 being connected along a collinear longitudinal score line 34.

Glue spots 35 are applied to the end flaps 31 and 33 on the outside of the blank 10, and adhere to the areas 36 shown in dotted relief in FIG. 1 on the end flaps 30, 32, for creating the automatic end closure. When the container 25 is erected, the end flaps 30 and 32 interlock in a conventional manner, as shown in FIG. 5, to provide rigidity to the automatic end closure.

Referring again to FIG. 1, an end wall flap 40 is hingedly connected along a longitudinal line 41 to the top panel 12 for creating an openable and closable product insertion opening in the erected container. The end wall flap includes a conventional tuck flap 42 for inserting into the erected container.

The end wall flap 40 is connected to the front side wall 15 and the rear side wall 16 via connecting webs or dust flaps 45, 46, respectively. The dust flap 46 is connected to the end wall flap 40 along a part of the transverse score line 21, while the dust flap 45 is connected to the end wall flap along an extension of the transverse score line 20. These connections are shown at 47 and 48, respectively. Accordingly, the front and rear side panels 15, 16 remain connected to the end wall flap 40 after the removable portion of the top panel 12 is torn away, thereby maintaining the structural integrity of the container.

When the end wall flap 40 is closed, the dust flaps 45, 46 fold inwardly along connections 47, 48 and their connections to panels 15, 16 and are forced to bend in the center along fold lines 51, 52. The fold lines 51, 52 extend outwardly from the intersection of the end wall flap 40 and the front and rear wide walls 15, 16, as best seen in FIG. 2. The product insertion opening of the container is closed by folding the end wall flap 40 against the open end of the container and by inserting the tuck flap 42 beneath the edges 53, 54 of the dust flaps 45, 46, which frictionally retain the tuck flap 42.

A tear-away portion 60 is defined in the top panel 12 and front side wall 15, as may be seen in FIG. 2. The tear-away portion 60 is partially defined in the blank of FIG. 1 by a score line or zipper score comprising a plurality of spaced-apart cuts. In the preferred embodiment, a zipper score line 61 is provided between the top panel 12 and the end wall flap 40 to define one edge of the tear-away portion. A second zipper score 62 is defined along a portion of the longitudinal score line 34 at the juncture between the top panel 12 and the end flap 32. Note in FIG. 1 that the zipper score 62 is provided only along a portion of the juncture between the top panel 12 and the end flap 32, leaving another portion 63 of the longitudinal score line 34 fully connected and merely creased.

Both of the zipper scores 61, 62 are defined by a plurality of spaced-apart cuts in the container material which define a plurality of container material bridges 64 (FIG. 6) between the tear-away portion 60 of the top panel and the remainder of the container. The blank 10 is preferably oriented with the grain of the paperboard running longitudinally, that is, along the line of tearing of scores 61 and 62, so that the bridges 64 are operative to twist without delamination when the container is folded along the zipper scores 61, 62 in the flattened configuration. The zipper scores are further operative to permit controlled delamination along the line defined by the scores when the tear-away portion of the top panel is removed.

Figure 6:
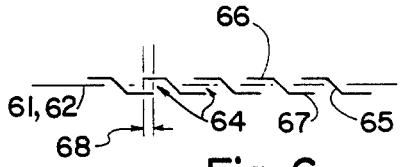
FIG. 6 is a detailed view of the tear score line employed in the preferred embodiment for removal of a portion of the top of the container.

More particularly, the spaced-apart cuts of the zipper scores 61, 62 are generally Z-shaped, as shown in FIG. 6. Each of the Z-shaped cuts includes a center cut line 65 oriented angularly with respect to the line of tearing (shown as a dashed line) of the zipper score 61. A pair of generally parallel cut lines 66, 67 extend in opposite directions from the ends of the center cut line 65 generally along the direction of the zipper score line 61. Each one of the parallel cut lines 66, 67 overlaps an adjacent one of the parallel cut lines of the adjacent Z-shaped cut, as shown at 68, such that a line drawn normal to the end of one of the parallel cut lines intersects the adjacent one of the parallel cut lines of the adjacent Z-shaped cut.

Figure 3:
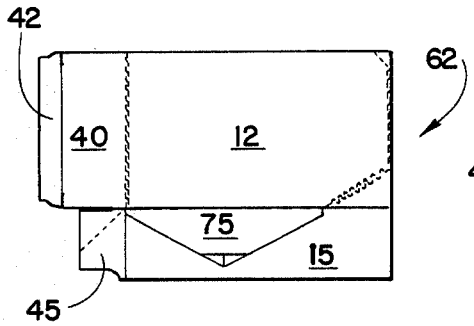
FIG. 3 is a top view of the container shown in FIG. 2 in the flattened configuration.
Figure 4:
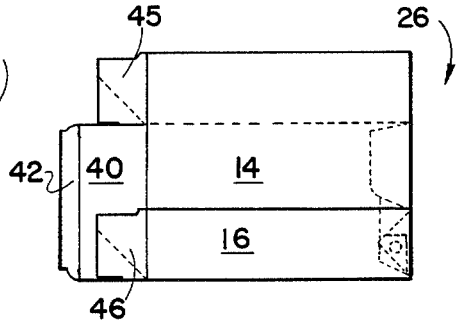
FIG. 4 is a bottom view of the container shown in FIG. 2 in the flattened configuration.

The particular Z-shaped cuts allow twisting of the container material bridges 64 between parallel cut lines of adjacent cuts when the container is folded. In particular, when the container is folded in the flattened configuration such as shown in FIGS. 3 and 4, the zipper score 62 is caused to fold 180 degrees. With the particular Z-shaped cuts disclosed herein, the container material does not delaminate when folded, but advantageously twists in the container material bridge 64 as the edge at the automatic end closure is folded inwardly to flatten the containers.

After the container is erected, and the tear-away portion 60 is to be removed, the zipper scores 61, 62 permit controlled delamination along the line of the zipper scores. Thus, upon removal of the tear-away portion, if the paperboard tends to tear transversely from the end of one of the parallel cut lines 66, 67, the tear will meet an adjacent one of the parallel cut lines of the adjacent Z-shaped cut and be directed along the adjacent cut. Accordingly, the zipper scores 61, 62 remain strong enough to hold the carton together during shipment, and then tear away easily when the container is converted into a tray. Since the lines of the zipper scores 61, 62 are aligned with the grain of the paperboard, because of the construction of the zipper scores, the folding along the scores causes twisting of the paperboard fibers without tearing them.

At the juncture between the top panel 12 and the end flap 32 of the automatic end closure, a conventional tear-away score 70 extends from the end of the zipper score 62 diagonally across the corner of the top panel 12, creating a reinforcing connecting web 71. The connecting web 71 is left in place because in the automatic end closure, the end flaps 31 and 32 are not glued together but are held in position by the interlocking of flaps 30 and 32. Thus, the connecting web 71 joins the interlocking automatic end closure to the front side wall 15, and maintains the structural integrity of the container when the top is torn away.

At the end of the zipper score 62 opposite the connecting web 71, a short jump-cut score 72 runs diagonally across the corner of the top panel 12 so that the machining of the blank does not have to extend entirely into the corner. At this corner of the completed container, the end flaps 32 and 33 are glued together.

The transverse score line 21 defines another edge of the tear-away portion 60. Because the tear-away portion is torn away along this score 21 after the zipper score lines 61, 62 have been torn, much better leverage is obtained in removing the tear-away portion and the score 21 does not need to tear away as easily as the zipper scores 61, 62. Accordingly, a fine jump-cut is preferable and gives adequate structural strength to the erected container.

Still further defining the tear-away portion 60 is a panel 75 of the front side wall 15 which remains integrally connecated along the transverse score line 20 to the top panel 12. This panel 75 of the front panel 15, when removed, defines a substantially V-shaped opening which is relatively wide for accessing product in the container near the top panel, and a relatively narrow opening toward the bottom panel for inserting a finger to grasp the panel 75 for removal.

In FIG. 1, the removed panel 75 of the front side wall 15 is defined by reverse-cut scorings 76, 77 placed in a V-shape in the front side wall 15. Those skilled in the art will understand that a reverse cut comprises a cut part way into the paperboard from opposite sides of the paperboard along parallel spaced-apart lines, whereby controlled delamination of the paperboard occurs when the panel is grasped and pulled outwardly. This type of tear-away scoring is used to provide strength prior to opening.

At the end of the reverse cut tear-away scorings 76, 77, a pair of short, almost full cut tear-away scorings 78, 79 are provided to easily tear away. Intersecting full cuts 81, 82, and 83 at the narrow lower extreme of the panel 75 allow the surrounding paperboard to be pushed inwardly, permitting insertion of a finger to grasp the panel 75 for removal.

It will now be appreciated that the tear-away portion 60 in the preferred embodiment extends between the zipper scores 61, 62 across the entire top panel 12, to both of the end closures of the erected container. Accordingly, there is provided convenient access to the product carried within the container and easy removal of the product from the open tray defined after removal of the tear-away portion 60, as illustrated in FIG. 5.

In order to assemble the container, the flaps of the automatic end closure are folded against the top, bottom and side walls in a conventional manner. The glue spots 35 are applied, and glue is applied to the glue flap 22. The bottom panel 14 is folded about transverse score line 19, and then the side wall 16 is folded about transverse score 21 to connect the bottom and side panels and to complete the automatic end closure. The container will then assume the flattened configuration shown in FIGS. 3 and 4. Advantageously, the empty and flattened containers may be shipped to an intermediate user such as a product manufacturer for loading product in the container.

When such a user desires to erect the container for loading product, pressure is simply applied inwardly to the folded scores, which will cause the end flaps 30–33 of the automatic end closure to slide past one another and lock themselves together in a well known manner. The erected configuration is illustrated in FIG. 2. Product can then be inserted into the container and the tuck flap 42 inserted between the edges 53, 54 of the dust flaps 45 and 46 to close the container. The filled containers may then be shipped carrying product without fear of premature separation along any of the perforated score lines.

In order to remove product from the container for dispensing, especially for removing one of a stack of products carried in the container, the end user inserts a finger into the opening defined by the full cuts 81–83, grasps the panel 75 of the front side wall 15, and pulls outwardly. The panel 75 will delaminate along the reverse-scorings 76, 77 and the pair of almost-full cut scorings 78, 79. An upward continuing pull will separate the portion 60 across the conventional tear-away score 70, and along the zipper scores 61, 62. A transverse and upward pull along the transverse jump-cut score line 21 tears the tear-away portion away from the container, exposing the product carried in the container. The container then assumes an open tray as illustrated in FIG. 5.

It will be seen that when the tear-away portion 60 has been removed, the structural integrity of the container is maintained by the connecting webs or dust flaps 45, 46, which maintain the end wall flap 46 connected to the front and rear side walls of the container and by the connecting web 71, which maintains the connection between the front side wall 15 and the automatic end closure 26. Thus, product can be kept in the open-top container tray and still be retained and protected by the walls of the container.

While this invention has been described in detail with regard to a preferred embodiment thereof, it should be understood that variations and modifications can be made without departing from the spirit and scope of the invention as defined in the following claims.

We claim:

1. A cut and scored blank for a self-erecting, end-loading, top-dispensing container, said container being convertible from a substantially flattened configuration for shipping the empty containers into an erected box-like configuration for loading product into the container and for shipping loaded containers, said container being further convertible into a tray having an open top for dispensing product, comprising:

a substantially rectangular first panel member;

a first side wall member hingedly connected at a first transverse score line to one edge of said first panel member;

a second side wall member hingedly connected at a second transverse score line to the edge of said first panel member opposite said first side wall member;

a substantially rectangular second panel member hingedly connected at a third transverse score line to said first side wall member;

glue flap means hingedly connected at a fourth transverse score line to permit securing said second panel member to said second side wall member;

an end wall flap hingedly connected at a longitudinal score line to said first panel member and including a tuck flap for inserting into the assembled container to form an openable and closable product insertion end wall opening;

tear score means for removing a substantial portion of said first panel member to define an open-topped tray for dispensing product carried within the container;

first web connecting means joining said end wall flap to said first side wall member;

second web connecting means joining said end wall flap to said second side wall member;

each of said web connecting means including a score line extending outwardly from the intersection of said end wall flap and said side wall member for folding said web connecting means when said end wall flap in closed; and interlocking flap means hingedly attached at a longitudinal score on the side of the blank opposite said end wall flap and defining an automatic end closure which assumes a disassembled flattened configuration when the container is in its flattened configuration and which automatically interlocks to form an assembled end wall for the container when the container is caused to assume its erected configuration.

2. A blank according to claim 1, wherein said tear score means comprises a line defined by a plurality of spaced-apart cuts in the container material, said cuts defining a plurality of container material bridges between said portion of said first panel member and the remainder of the blank, said bridges being operative to twist without delamination when the blank is folded along said line and being further operative to permit controlled delamination along said line when said portion of said first panel member is removed.

3. A blank according to claim 2, wherein said plurality of spaced-apart cuts comprises a plurality of generally Z-shaped cuts, each of said Z-shaped cuts including a center cut line oriented angularly with respect to said tear score line and a pair of generally parallel cut lines extending in opposite directions from the ends of said center cut line generally along the direction of said tear score line, each one of said parallel cut lines overlapping an adjacent one of the parallel cut lines of the adjacent Z-shaped cut such that a line drawn normal to the end of said one of said parallel cut lines intersects said adjacent one of the parallel cut lines of the adjacent Z-shaped cut.

4. A blank according to claim 1, further comprising means defining a second tear score along a portion of one of said side wall members for removing a portion of said one of said side wall members together with said portion of said first panel member so as to allow access to product carried within the container when assembled.

5. A blank according to claim 4, wherein said second tear score means defines a tear score line in said one of said side wall members which creates a relatively wide opening for accessing product near said first panel member and a relatively narrow opening disposed away from said first panel member for inserting a finger to grasp said portion of said one of said side wall members.

6. A blank according to claim 4, wherein said second tear score means comprises a separation line defined by reverse-cutting the container material to permit separation by controlled delamination of the container material when said portion of said one of said side wall member is removed.

7. A blank according to claim 1, further comprising third web connecting means joining said interlocking flap means to one of said side wall members and remaining when said portion of said first panel member is removed.

8. A blank according to claim 1, wherein said tear score means is defined along said longitudinal score line of said end wall flap and along at least a portion of said longitudinal score of said interlocking flap means.

9. An erectable, end-loading, top-dispensing container, the container being convertible from a substantially flattened configuration for shipping, into an erected box-like configuration for loading product into the container, the container being further convertible into a tray having an open top for dispensing product, comprising:

a top panel;

a bottom panel supported in spaced apart relation to said top panel;

a front side wall connecting said top panel to said bottom panel;

a rear side wall connecting said top panel to said bottom panel;

interlocking flap means defining an automatic end closure for the container, said flap means assuming a disassembled flattened configuration when the container is in its flattened configuration and automatically interlocking to form an assembled end wall for the container when the container is caused to assume its erected configuration;

hinged flap means attached to the container opposite said interlocking flap means and including a tuck flap insertable adjacent said bottom panel, said hinged flap means defining an openable and closable product insertion opening when the container is caused to assume its erected configuration;

a first connecting web joining said hinged flap means to said front side wall;

a second connecting web joining said hinged flap means to said rear side wall;

each of said connecting webs including a score line extending outwardly from the intersection of said hinged flap means and said side walls, for folding said web when said hinged flap means is closed; and means defining a tear score for removing a substantial portion of said top panel to define an open-topped tray for dispensing product carried within the container, said tear score comprising a line defined by a plurality of spaced-apart cuts in the container material, said cuts defining a plurality of container material bridges between said portion of said top panel and the remainder of the container, said bridges being operative to twist without delamination when the container is folded along said line in the flattened configuration and being further operative to permit controlled delamination along said line when said portion of said top panel is removed.

* * * * *